US007431800B2

(12) United States Patent
Ferm et al.

(10) Patent No.: US 7,431,800 B2
(45) Date of Patent: Oct. 7, 2008

(54) DEVICE AND METHOD FOR ON-LINE CONTROL OF THE FIBRE DIRECTION OF A FIBRE WEB

(75) Inventors: Johan Ferm, Mellerud (SE); Anders Hubinette, Karlstad (SE)

(73) Assignee: Stora Enso AB, Falun (SE)

( * ) Notice: Subject to any disclaimer, the term of this patent is extended or adjusted under 35 U.S.C. 154(b) by 459 days.

(21) Appl. No.: 10/512,599

(22) PCT Filed: Apr. 15, 2003

(86) PCT No.: PCT/SE03/00599

§ 371 (c)(1),
(2), (4) Date: Oct. 11, 2005

(87) PCT Pub. No.: WO03/089716

PCT Pub. Date: Oct. 30, 2003

(65) Prior Publication Data

US 2006/0048910 A1 Mar. 9, 2006

Related U.S. Application Data

(60) Provisional application No. 60/378,979, filed on May 10, 2002.

(30) Foreign Application Priority Data

Apr. 22, 2002 (SE) ..... 0201188

(51) Int. Cl.
*D21F 1/02* (2006.01)
*D21F 11/02* (2006.01)
*D21F 7/06* (2006.01)

(52) U.S. Cl. ..... 162/259; 162/198; 162/262; 162/263; 162/346; 162/DIG. 11; 700/128

(58) Field of Classification Search ..... 162/198, 162/131, 252, 259, 262, 263, 315, 336, 344, 162/346, DIG. 10, DIG. 11; 700/127–129
See application file for complete search history.

(56) References Cited

U.S. PATENT DOCUMENTS 5,833,808 A 11/1998 Shands et al.
6,322,666 B1 * 11/2001 Luontama et al. ..... 162/198
6,799,083 B2 * 9/2004 Chen et al. ..... 700/128

* cited by examiner

*Primary Examiner*—Eric Hug
(74) *Attorney, Agent, or Firm*—Greer, Burns & Crain Ltd

(57) ABSTRACT

A device and a method for on-line control of the fibre direction of a fire web (8), being manufactured from stock delivered from a headbox (3) through a discharge opening (11) defined by movable lips (9, 10), while using a fibre direction meter (12) located downstream and actuating members (14), which are allonged long the lips for regulation of the discharge opening as a response to individual control signals, each being a function of measured fibre direction values; wherein a control unit (13) receives the measured fibre direction values, calculates the control signals, and transmits these to the actuating members. According to the invention, the control unit identifies an array of fibre direction values, originating from positions in the cross direction of the fibre web which correspond to the positions of the actuating members. The control unit then compares the array of fibre direction values with an array of desired fibre direction values.

9 Claims, 2 Drawing Sheets

DEVICE AND METHOD FOR ON-LINE CONTROL OF THE FIBRE DIRECTION OF A FIBRE WEB

This application is a 371 of PCT/SE03/00599, filed Apr. 15, 2003, which claims the benefit of provisional application 60/378,979, filed May 10, 2002.

FIELD OF THE INVENTION

The present invention relates to devices and methods for on-line control of the fibre direction of a continuous fibre web in a paper or board machine.

BACKGROUND OF THE INVETION

The present invention relates to a device for on-line control of the fibre direction of a continuous fibre web in a paper or board machine, comprising at least one former including at least one headbox being arranged for delivering a stock, which in the former is formed into said fibre web, through a slice including lips which are movable in relation to each other and define a discharge opening, said device including:

- a fibre direction meter arranged downstream the former for measuring the fibre direction of the fibre web;
- a predetermined number of actuating members, which are arranged in predetermined positions along said lips for regulating the discharge opening locally as a response to individual control signals, each being a function of measured fibre direction values; and
- a control unit, which is arranged for receiving the measured fibre direction values from the fibre direction meter, calculating said control signals, and transmitting the control signals to the actuating members.

The invention also relates to method for on-line control of the fibre direction of a continuous fibre web in a paper or board machine comprising at least one former including at least one headbox being arranged for delivering a stock, which in the former is formed into said fibre web, through a slice including lips which are movable in relation to each other and define a discharge opening, said method including:

- measuring the fibre direction of the fibre web by means of a fibre direction meter arranged downstream the former;
- calculating and transmitting individual control signals, each being a function of measured fibre direction values, to a predetermined number of actuating members which are arranged in predetermined positions along the lips for regulating the discharge opening locally as a response to the control signals.

Within the field of papermaking, it is known to professionals that the fibre direction in a finished paper sheet, i.e. the main orientation of the cellulose fibres in the sheet, influences the sheet properties to a great extent. When manufacturing paper, generally, a uniform distribution of fibre direction along the entire paper web is aimed at, i.e. that the orientation of the fibres is similar in the machine and cross directions of the paper web. For example, it is known that properties of board, such as flatness, stiffness, bending resistance, stretch and printability, are improved by a uniform distribution of fibre direction. Accordingly, a uniform distribution of fibre direction leads to fewer rejections of, and complaints on, the finished paper product.

In accordance with the so-called vector theory within papermaking, the parameters which control the fibre direction are the wire speed, the discharge velocity of the stock and the discharge direction of the stock in relation to the machine direction. It is known to arrange a measurement system in a paper machine in order to measure the fibre direction of the paper web in the cross direction, when the paper web passes the system. The result from such a measurement system is presented usually as a so-called fibre orientation profile, which is a diagram illustrating how the fibre direction varies in the cross direction of the paper web. Based upon the measured fibre direction, working staff can then reduce any variations of fibre direction by means of adjusting the headbox of the paper machine manually, e.g. by means of manual adjustment of the edge valves of the headbox or the discharge ratio, i.e. the ratio of stock discharge velocity/wire speed.

This method of reducing variations of fibre direction, however, is difficult and irrational. Firstly, said manual adjustments are comparatively difficult to predict. Thus, a minor adjustment may result in an uncontrolled change of the fibre direction. Secondly, it is difficult to predict how said adjustments, alone or in combination with each other, influence the fibre direction. Even if the working staff has a long experience of papermaking, the adjustment methodology tends to follow the principle "screw and see", i.e. the working staff measures the fibre direction and adjusts the headbox indiscriminately in an iterative process until a sufficiently uniform distribution of fibre direction has been obtained. This adjustment method is ineffective, and a considerable time may elapse before an acceptably uniform distribution of fibre direction has been obtained, during which period the manufactured paper web runs the risk of having to be rejected.

SUMMARY OF THE INVENTION

An object of the present invention is to remedy these problems, and to provide a device and a method which offer on-line control of the fibre direction and which, during the current paper manufacture, enable a rapid and accurate reduction of variations of the fibre direction.

The device according to the invention is characterized in that:

- the control unit is arranged for identifying an array of fibre direction values $\{v_1\ v_2\ v_3 \ldots v_N\}$, of the measured fibre direction values, said fibre direction values of said array originating from positions in the cross direction of the fibre web which correspond to the positions of the actuating members; that
- the control unit is arranged for comparing the identified array of fibre direction values with an array of desired fibre direction values $\{b_1\ b_2\ b_3 \ldots b_N\}$, by means of calculating an array of error values, $\{e_1\ e_2\ e_3 \ldots e_N\}=\{b_1-v_1\ b_2-v_2\ b_3-v_3 \ldots b_N-v_N\}$; and that
- the control unit is arranged for calculating said control signal for each actuating member as a function of a predetermined number of said error values in accordance with $$s_n = e_n C_0 + \sum_{i=1}^{i=J} C_i(e_{n+i} - e_{n-i}),$$

where J is a predetermined integral number and $C_0\ C_1\ C_2 \ldots C_J$ are predetermined constants.

The method according to the invention is characterized in:

- identifying an array of fibre direction values, $\{v_1\ v_2\ v_3 \ldots v_N\}$, of the measured fibre direction values, said fibre direction values of said array originating from positions in the cross direction of the fibre web which correspond to the positions of the actuating members;

comparing said identified array of fibre direction values with an array of desired fibre direction values, $\{b_1\ b_2\ b_3 \ldots b_N\}$, by means of calculating an array of error values in accordance with $\{e_1\ e_2\ e_3 \ldots e_N\}=\{b_1\text{-}v_1\ b_2\text{-}v_2\ b_3\text{-}v_3 \ldots b_N\text{-}v_N\}$; and calculating each of said control signals as a function of a predetermined number of said error values in accordance with $$s_n = e_n C_0 + \sum_{i=1}^{i=J} C_i(e_{n+i} - e_{n-i}),$$

where J is a predetermined integral number and $C_0\ C_1\ C_2 \ldots C_J$ are predetermined constants.

Owing to the facts that the discharge opening at each actuating member can be regulated locally and that the control signals are a function of the measured fibre direction, undesired fibre direction variations can be substantially continuously corrected. Preferably, the control signals are calculated by a microprocessor, being included in a control unit arranged for receiving the measured fibre direction from the fibre direction meter and for transmitting the control signals to the actuating members after the calculation. Accordingly, the control of the fibre direction takes place without any manual actions, which enables a rapid and accurate control.

BRIEF DESCRIPTION OF THE DRAWINGS

In the following, the invention will be described further with reference to the figures.

DETAILED DESCRIPTION OF THE PREFERRED EMBODIMENTS

Figure 1:
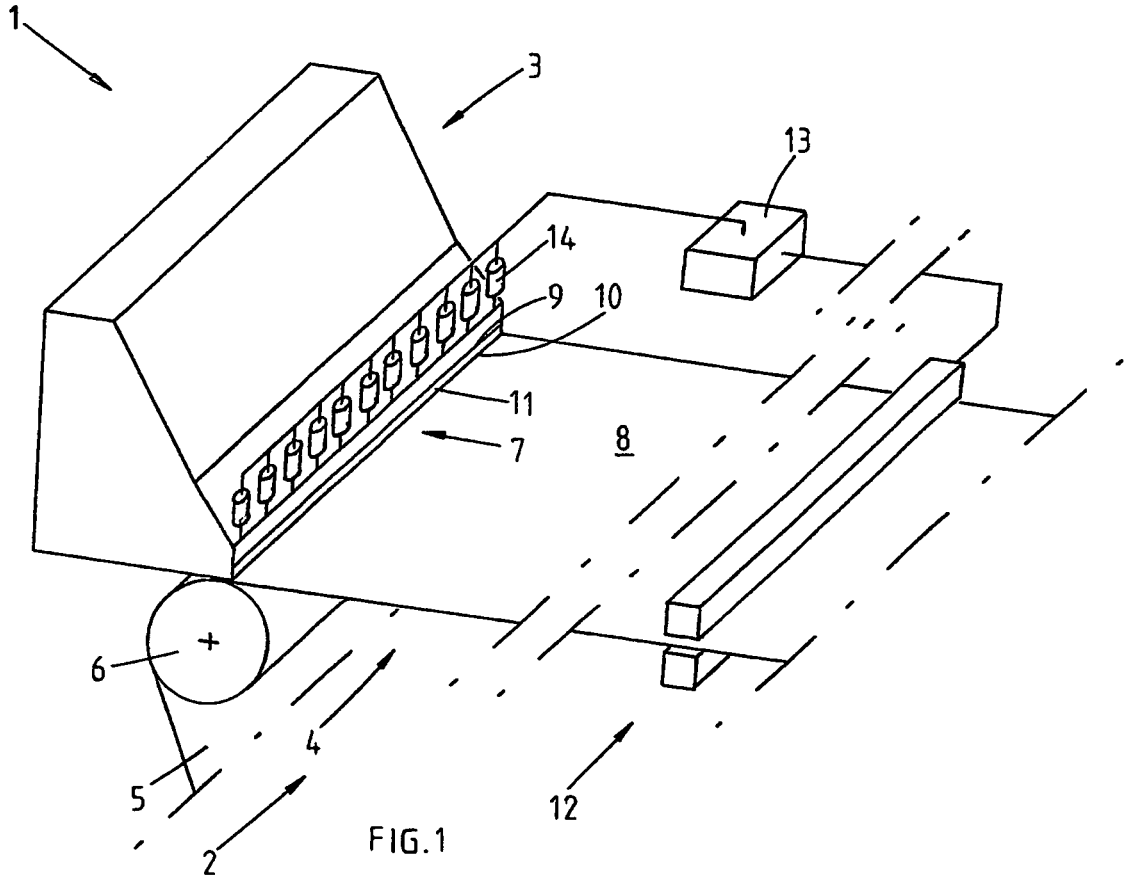
FIG. 1 is a schematic representation of portions of a paper machine in which a device according to the invention has been mounted.

FIG. 1 is a schematic representation of a board machine 1, which comprises a former 2, including a headbox 3 and a wire part 4, in this case a fourdrinier former. The wire part 4 includes a wire 5 and a breast roll 6 around which the wire 5 runs. The headbox 3 is arranged for delivering stock through a slice 7 to the wire part 4 in which the stock is dewatered in order to form a continuous network of fibres, i.e. a fibre web 8. The slice 7 includes two lips 9, 10 which are arranged for being movable in relation to each other in order to form an adjustable discharge opening 11 through which the stock passes.

Downstream the former 2, in a position where the fibres have been fixed in the formed network, a fibre direction meter 12 is arranged for measuring the orientation of the fibres. Preferably, the fibre direction meter 12 is located in, or downstream, the drying section (not shown) of the board machine 1, but in principle, it can be located anywhere along the run of the fibre web 8, provided that the fibres in the selected position have been fixed in the network. Preferably, the fibre direction meter 12 includes a laser-camera assembly (not shown), which performs a reciprocating motion in the cross direction of the fibre web 8 in order to measure the fibre direction in the cross direction of the fibre web 8. The fibre direction meter 12 is connected to a control unit 13 which controls the laser-camera assembly and which receives and processes the measured fibre direction values. A suitable meter, for example, is the one marketed by ABB AB, Sweden, under the name "AccuRay® Smart Fiber Orientation Sensor".

According to the invention, the slice 7 includes a predetermined number N of actuating members 14 which are placed in predetermined positions, preferably uniformly distributed, for example with a distance of approximately 10 cm between each other, along the lips 9, 10. Each actuating member 14 is arranged for controlling the stock flow in its position in relation to the stock flow in adjacent positions. This is achieved by means of each actuating member 14 setting an individual value for the discharge opening as a response to a control signal from the control unit 13. Accordingly, the actuating members 14 are connected to the control unit 13 in order to obtain their respective control signals therefrom. In the embodiment according to FIG. 1, the actuating members 14 are connected to the upper lip 9, which is movable, in order to operate the upper lip 9 in relation to the lower lip 10, which is stationary, and thereby adjust the discharge opening 11 in the different positions. Accordingly, the upper lip 9 is yieldable to some extent, so that different values can be set for the discharge opening 11 along the length of the slice 7.

Figure 2:
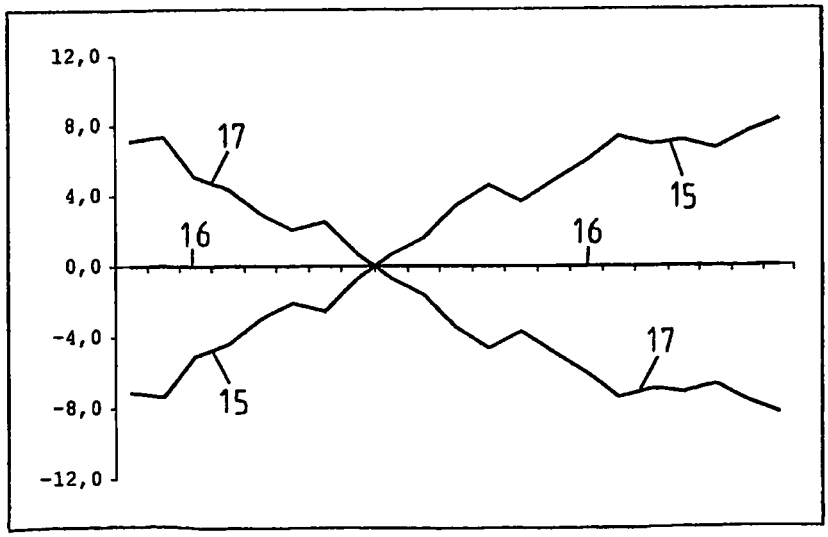
FIG. 2 shows fibre orientation profiles, which illustrate how an irregular fibre orientation profile is corrected.
Figure 3:
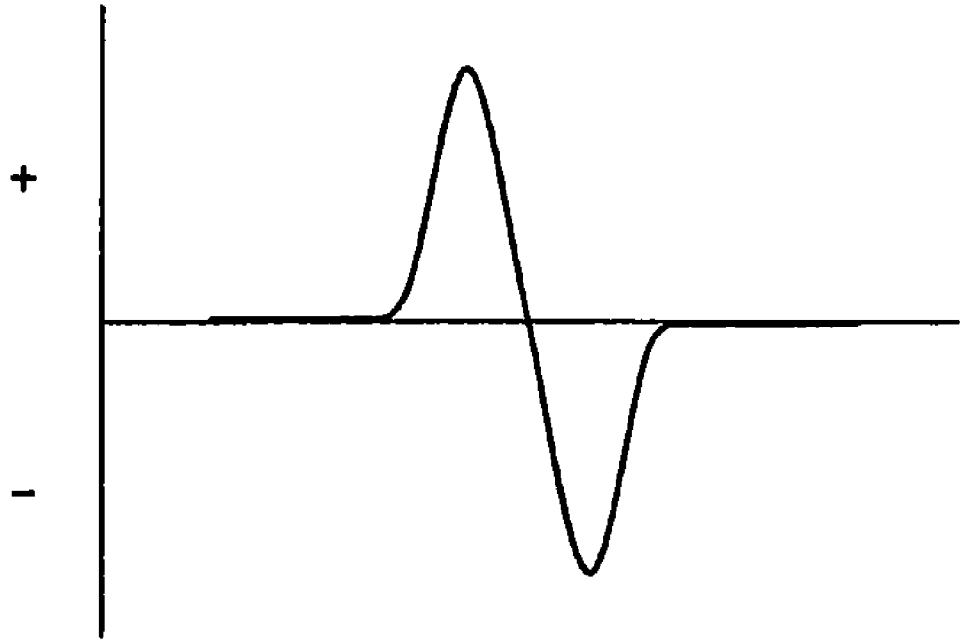
FIG. 3 shows a fibre orientation profile, which illustrates how the fibre direction is changed by a local reduction of the discharge opening of a headbox in the case when the discharge velocity of the stock is lower than the wire speed.
Figure 4:
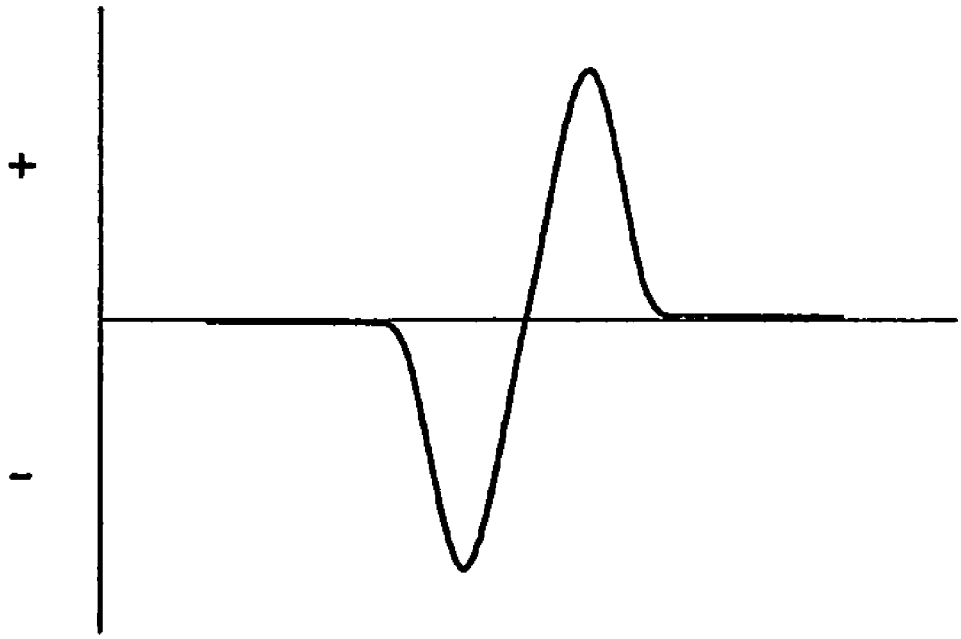
FIG. 4 shows a fibre orientation profile, which illustrates how the fibre direction is changed by a local increase of the discharge opening of a headbox in the case when the discharge velocity of the stock is lower than the wire speed.

In the following, the method by means of which said control signals are calculated will be described with reference to FIGS. 2-4.

The method includes the step of the fibre direction meter 12 measuring the fibre direction in the cross direction and transmitting the measured fibre direction values to the control unit 13. Accordingly, the measured fibre direction values describe a fibre orientation profile in the cross direction of the fibre web 8. The graph 15 in FIG. 2 is a graphic illustration of such a profile. From the graph 15, it is evident that the fibre direction in this case makes an angle with the direction of travel of the fibre web 8, i.e. with the machine direction, which angle is approximately −7° at one edge of the fibre web 8 and increases in the cross direction of the fibre web 8 to a value of approximately 8° at the other edge. Accordingly, the fibre web 8 exhibits an irregular fibre orientation profile in this case.

From the measured fibre direction values, the control unit 13 identifies an array of fibre direction values, $$\{v_1\ v_2\ v_3 \ldots v_N\},$$

which values, being angular values between the fibre direction and the machine direction, originate from positions in the cross direction corresponding to the positions of the actuating members 14.

The measured fibre direction values are then compared with an array of desired fibre direction values, $$\{b_1\ b_2\ b_3 \ldots b_N\},$$

which define a desired fibre direction profile. Normally, it is desirable that the main fibre direction coincides with the machine direction across the entire width of the fibre web 8, and therefore all desired fibre direction values normally are set to be 0°, as illustrated by the graph 16 in FIG. 2. In principle, however, also other desired fibre direction profiles can be chosen.

The above-mentioned comparison takes place by means of the control unit 13 calculating an array of error values in accordance with $$\{e_1\ e_2\ e_3 \ldots e_N\}=\{b_1\text{-}v_1\ b_2\text{-}v_2\ b_3\text{-}v_3 \ldots b_N\text{-}v_N\},$$

i.e. by means of calculating the difference between the measured and the desired fibre direction values. In FIG. 2, the graph 17 illustrates the calculated error values. Accordingly, the error values define an error profile which corresponds to the correction of the fibre direction which has to be performed in order to obtain the desired fibre direction profile.

Thereafter, the control unit 13 calculates the control signal for each actuating member as a function of the error values. Thus, the control signal s to the actuating member in the position n can be written generally as $$s_n=f(\ldots e_{n-1}, e_n, e_{n+1} \ldots).$$

According to the above-mentioned vector theory, however, it is known how a local change of the stock flow influences the fibre direction. If, for example, the discharge velocity of the stock is lower than the wire speed, a local reduction of the discharge opening in a certain position n means that the fibre direction is influenced as is evident from the fibre orientation profile in FIG. 3. To the left of the position n, the fibres are turned clockwise, i.e. in a positive direction, and to the right of the position n the fibres are turned counter-clockwise, i.e. in a negative direction. In the same fashion, it is known how the fibre direction is influenced by a local increase of the discharge opening, which is illustrated in FIG. 4.

Accordingly, a local change of the discharge opening in a certain position normally influences the fibre direction in adjacent positions. Consequently, the control signal $s_n$ to the actuating member in the position n preferably should be a function of a predetermined number of error values, preferably at least two error values, originating from neighbouring positions, i.e. n−1, n+1, n−2, n+2 . . . .

The control unit 13 then calculates each control signal in accordance with $$\begin{aligned} s_n &= e_nC_0 + e_{n+1}C_1 + e_{n+2}C_2 + \ldots + e_{n+J}C_J - \\ &\quad (e_{n-1}C_1 + e_{n-2}C_2 + \ldots + e_{n-J}C_J) \\ &= e_nC_0 + \sum_{i=1}^{i=J} C_i(e_{n+i} - e_{n-i}), \end{aligned}$$

where J is a predetermined integral number and $C_0\ C_1\ C_2 \ldots C_J$ are predetermined constants. If J, for example, is selected to be 5, the control signal $s_n$ to the actuating member in the position n consequently will be a function of both the error values in the position n and in the adjacent positions n+1, n−1, n+2, n−2, n+3, n−3, n+4, n−4, n+5 and n−5. Accordingly, the constants define a filter having a width which is determined by the choice of J.

In order to calculate the control signals to the J outermost actuating members on each side, i.e. the actuating members in the positions n=1 to n=J and n=N−J to n=N, the dummy error values $e_{-J+1}$ to $e_0$ and $e_{N+1}$ to $e_{N+J}$, which are set to be 0, are inserted.

Preferably, the control unit 13 includes a microprocessor (not shown) which performs the above-mentioned calculations. When the control unit 13 has calculated the control signals, these are transmitted to the actuating members 14, preferably via a suitable regulator (not shown).

When performing trials in a machine for manufacturing board, a 50% reduction of fibre direction variations in the cross direction of the fibre web has been achieved by means of using different filters according to the above-described method. Examples of such filters are:

$C_0$=0
$C_1$=0.0650
$C_2$=0.3150
$C_3$=0.5000
$C_4$=0.3150
$C_5$=0.0650
$C_6$=0 and $C_0$=0
$C_1$=0.0326
$C_2$=0.1599
$C_3$=0.4144
$C_4$=0.7360
$C_5$=0.9670
$C_6$=0.9670
$C_7$=0.7360
$C_8$=0.4144
$C_9$=0.1599
$C_{10}$=0.0326
$C_{11}$=0.

In the first example is J=6, and in the second example is J=11. Alternatively, larger filters can be utilised, for example such where J=30 or even J=60. However, the filters are machine-specific and, even if these filters have proven to function well in the board machine in question, it is evident that other filters may be preferable in other paper or board machines. In the examples above, all constants are equal to or larger than 0, which is preferred, but also negative values can be utilised for the constants. However, it is preferred that the constant $C_0$ is chosen to be 0 since, in accordance with the description given in connection with FIGS. 3 and 4, as a rule, a correction of the fibre direction in the position n will not be promoted by a change of the discharge opening in said position n.

In order to ensure that the fibre direction is kept within prescribed limit values, it is preferred that the above-described steps, i.e. measurement of the fibre direction, calculation of appropriate control signals, and adjustment of the discharge opening in accordance with these control signals, take place substantially continuously during the paper manufacture. In practice, however, it takes a certain time for the fibre direction meter 12 to scan across the width of the fibre web 8 when measuring the fibre direction, and therefore it may instead be more practical to allow the discharge opening to change one to two times per minute, or with any other suitable time-interval.

It is evident that, within the scope of the invention, it is possible to use other algorithms than the one described above for calculating appropriate control signals from the measured fibre direction values. For instance, the average of the error profile can be calculated and corrected separately, or alternatively, the error profile can be divided into different wavebands which are treated separately, a technique which is known per se. It is also possible to apply additional filters in the algorithm, for example in order to reduce so-called "ringings" in the system.

It is also evident that the invention is applicable on different types of paper as well as board machines, and that these machines can include a plurality of formers and headboxes, where the invention is implemented.

The invention claimed is:

1. A device for on-line control of the fibre direction of a continuous fibre web in a paper or board machine, comprising at least one former including at least one headbox being arranged for delivering a stock, which in said former is formed into said fibre web, though a slice including lips which are movable in relation to each other and define a discharge opening, said device including:

a fibre direction meter arranged downstream the former for measuring the fibre direction of the fibre web;

a predetermined number of actuating members, which are arranged in predetermined positions along said lips for regulating the discharge opening locally as a response to individual control signals, each being a function of measured fibre direction values; and a control unit, which is arranged for receiving the measured fibre direction values from the fibre direction meter, calculating said control signals, and transmitting the control signals to the actuating members, wherein the improvement comprises:

the control unit is arranged for identifying an array of fibre direction values, $\{v_1\ v_2\ v_3 \ldots v_N\}$, of the measured fibre direction values, said fibre direction values of said array originating from positions in the cross direction of the fibre web which correspond to the positions of the actuating members;

the control unit is arranged for comparing the identified array of fibre direction values with an array of desired fibre direction values $\{b_1\ b_2\ b_3 \ldots b_N\}$ by means of calculating an array of error values, $\{e_1\ e_2\ e_3 \ldots e_N\}=\{b_1-v_1\ b_2-v_2\ b_3-v_3 \ldots b_N-v_N\}$;

the control unit is arranged for calculating said control signal for each actuating member as a function of a predetermined number of said error values in accordance with $$s_n = e_n C_0 + \sum_{i=1}^{i=J} C_i(e_{n+i} - e_{n-i}),$$

where J is a predetermined integral number and $C_0\ C_1\ C_2 \ldots C_J$ are predetermined constants; and wherein said calculations are performed b a microprocessor included within said the control unit.

2. A device according to claim 1, wherein the constants $C_1\ C_2 \ldots C_J$ are larger than 0.

3. A device according to claim 1, wherein $C_0=0$.

4. A device according to claim 2, wherein $C_0=0$.

5. A method for on-line control of the fibre direction of a continuous fibre web in a paper or board machine comprising at least one former including at least one headbox being arranged for delivering a stock, which in the former is formed into said fibre web, though a slice including lips which are movable in relation to each other and define a discharge opening, said method including:

measuring the fibre direction of the fibre web by means of a fibre direction meter arranged downstream the former;

calculating and transmitting individual control signals, each being a function of measured fibre direction values, to a predetermined number of actuating members, which are arranged in predetermined positions along the lips for regulating the discharge opening locally as a response to the control signals, wherein the improvement comprises:

identifying an array of fibre direction values, $\{v_1\ v_2\ v_3 \ldots v_N\}$, of the measured fibre direction values, said fibre direction values of said array originating from positions in the cross direction of the fibre web which correspond to the positions of the actuating members;

comparing said identified array of fibre direction values with an array of desired fibre direction values, $\{b_1\ b_2\ b_3 \ldots b_N\}$, by means of calculating an array of error values in accordance with $\{e_1\ e_2\ e_3 \ldots e_N\}=\{b_1-v_1\ b_2-v_2\ b_3-v_3 \ldots b_N-v_N\}$; and calculating each of said control signals as a function of a predetermined number of said error values in accordance with $$s_n = e_n C_0 + \sum_{i=1}^{i=J} C_i(e_{n+i} - e_{n-i}),$$

where J is a predetermined integral number and $C_0\ C_1\ C_2 \ldots C_J$ are predetermined constants.

6. A method according to claim 5, wherein the constants $C_1\ C_2 \ldots C_J$ are larger than 0.

7. A method according to claim 5, wherein $C_0=0$.

8. A method according to claim 6, wherein $C_0=0$.

9. A device for on-line control of the fibre direction of a continuous fibre web in a paper or board machine, comprising at least one former including at least one headbox being arranged for delivering a stock, which in said former is formed into said fibre web, though a slice including lips which are movable in relation to each other and define a discharge opening, said device comprising:

a fibre direction meter arranged downstream of the former for measuring the fibre direction of the fibre web;

a predetermined number of actuating members, which are arranged in predetermined positions along said lips for regulating the discharge opening locally as a response to individual control signals, each being a function of measured fibre direction values;

a control unit, said fibre direction meter and said actuating members being directly connected to said control unit, said control unit being arranged for receiving the measured fibre direction values from the fibre direction meter, calculating said control signals, and transmitting the control signals to the actuating members;

the control unit is arranged for identifying an array of fibre direction values, $\{v_1\ v_2\ v_3 \ldots v_N\}$, of the measured fibre direction values, said fibre direction values of said array originating from positions in the cross direction of the fibre web which correspond to the positions of the actuating members;

the control unit is arranged for comparing the identified array of fibre direction values with an array of desired fibre direction values $\{b_1\ b_2\ b_3 \ldots b_N\}$ by means of calculating an array of error values, $\{e_1\ e_2\ e_3 \ldots e_N\}=\{b_1-v_1\ b_2-v_2\ b_3-v_3 \ldots b_N-v_N\}$; and the control unit is arranged for calculating said control signal for each actuating member as a function of a predetermined number of said error values in accordance with $$s_n = e_n C_0 + \sum_{i=1}^{i=J} C_i(e_{n+i} - e_{n-i}),$$

where J is a predetermined integral number and $C_0\ C_1\ C_2 \ldots C_J$ are predetermined constants.

* * * * *

UNITED STATES PATENT AND TRADEMARK OFFICE

CERTIFICATE OF CORRECTION

PATENT NO. : 7,431,800 B2
APPLICATION NO. : 10/512599
DATED : October 7, 2008
INVENTOR(S) : Ferm et al.

It is certified that error appears in the above-identified patent and that said Letters Patent is hereby corrected as shown below:

| | |
|---|---|
| Claim 1, Col. 7, line 38 | After "performed," please delete "b" and insert --by-- in its place. |
| Claim 5, Col. 7, line 48 | Before "a slice," please delete "though" and insert --through-- in its place. |

Signed and Sealed this

Nineteenth Day of May, 2009

JOHN DOLL
*Acting Director of the United States Patent and Trademark Office*